United States Patent [19]

Demetriades

[11] Patent Number: 4,687,256

[45] Date of Patent: Aug. 18, 1987

[54] PROCESS FOR MANUFACTURING A NATURAL FIBER MOP

[76] Inventor: Peter G. Demetriades, 601 Wakefield Ave., Henderson, N.C. 27536

[21] Appl. No.: 837,790

[22] Filed: Apr. 17, 1986

Related U.S. Application Data

[62] Division of Ser. No. 648,248, Sep. 7, 1984, Pat. No. 4,615,065.

[51] Int. Cl.[4] ..... A46B 15/00; A47L 3/20

[52] U.S. Cl. ..... 300/21; 15/229 A; 428/375; 428/392; 428/393; 428/396

[58] Field of Search ..... 15/147 R, 147 A, 147 B, 15/147 C, 147 D, 148–154, 228, 229, 104.93, 104.94; 428/375, 392, 393, 396; 300/16, 21

[56] References Cited

U.S. PATENT DOCUMENTS

| | | | |
|---|---|---|---|
| 2,409,660 | 10/1946 | Briggs | 15/229 R |
| 4,289,824 | 9/1981 | Smith | 428/393 X |
| 4,374,176 | 2/1983 | Aoki et al. | 428/393 X |
| 4,468,428 | 8/1984 | Early et al. | 428/393 X |

*Primary Examiner*—Timothy V. Eley
*Attorney, Agent, or Firm*—Lalos, Keegan & Kaye

[57] ABSTRACT

A process for mop manufacturing to produce a mop having improved liquid retention properties without requiring breaking in or rinsing the mop, including the step of coating natural fibers such as cotton with a surfactant in the amount of up to 4.0% by weight of the surfactant per weight of the fiber while retaining substantially all the natural oils of the fiber.

11 Claims, 1 Drawing Figure

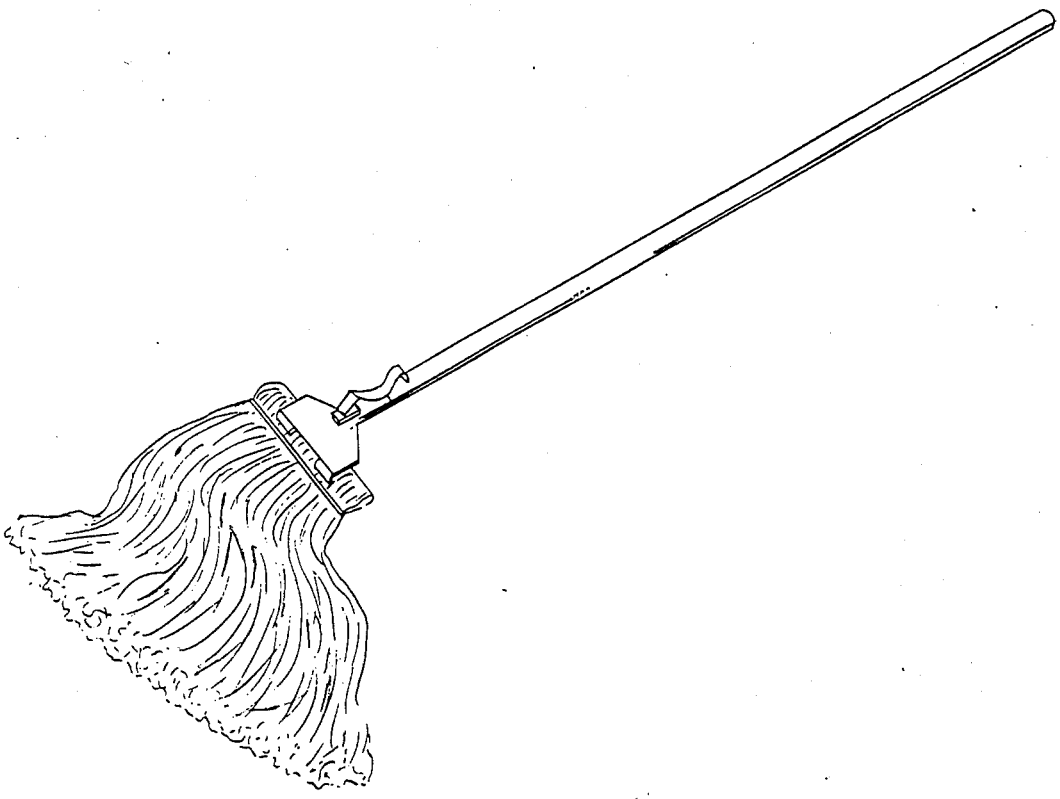

PROCESS FOR MANUFACTURING A NATURAL FIBER MOP

This is a divisional of co-pending application Ser. No. 648,248 filed on Sept. 7, 1984 now U.S. Pat. No. 4,615,065.

INTRODUCTION

This invention relates generally to cleaning implements and particularly to wet mops, swabs or dust mops. More particularly the present invention relates to natural fiber mops used for cleaning or preparing or otherwise treating or contacting surfaces.

BACKGROUND OF THE INVENTION

As used throughout this specification and claims, the term "mop" shall include a gathering of fibers in either the form of strands or yarns, ribbons or strips gathered and connected to form a working implement. Oftentimes such a mop would have a handle made of metal, wood or plastic that would be conventionally attached to the gathering of the fibers, strands, yarns, etc.

Typically such mops are manufactured from natural fibers, particularly cotton because of its high absorbency but also other natural fibers such as wool or the like might be used. Mops made from such natural fibers have heretofore required a break-in period prior to use by the end user whether industrial or retail consumer. This break-in requirement arises due to the fact that natural fibers contain non-absorbent, non-water soluble materials usually referred to as "oils" which retard if not inhibit the wetting or absorption of these aqueous materials by the fibers usually incorporated into the conventional cleaning compositions. It is well known to be a conventional requirement that this break-in period be undertaken before the mop can be successfully utilized.

For decades mop manufacturers utilizing natural fibers recommend to the industrial or consumer user that, prior to use, the mop be treated in either of two ways to attain the maximum absorbency by eliminating the adverse effect of the natural oils. The first form of recommended treatment is a soaking in any aqueous liquid and to do so for an extended period of time. The second recommendation is that the mops must be washed in soap or detergent to remove these non-soluble oils and therefore permit the mop to be more hydrophilic and thus more able to soak up the aqueous cleaning fluids and effect a more desirable cleaning operation.

It should be readily apparent that the break-in time required in either of these two methods to treat the natural fiber mops and rid these fibers of the natural oils is objectionable as being time consuming and, particularly for the industrial user, expensive. Natural fibers, particularly cotton, have lost some use amongst the mop manufacturers because of this requirement of break-in.

It is now recognized that the basic efficiency and effectiveness of the natural fiber mop after the break-in period is so desirable because of their otherwise lower manufacturing cost and outstanding absorbency that natural fiber mops continue to be used in spite of the break-in requirement. It was reasoned from this recognition that natural fiber use would be increased immeasurably and their attractiveness to the consumer and industrial user would be enhanced significantly if the break-in period were not required in order to achieve the high absorbency of aqueous materials.

SUMMARY OF THE INVENTION

The present invention includes a process for making a mop for treating surfaces wherein the mop possesses improved liquid retention properties without the requirement for the conventional breaking in or rinsing of the mop to achieve these high liquid retention capabilities. The process includes the steps of utilizing a plurality of natural fibers that possess the natural oils inherent in these fibers that may be cotton or wool, then gathering the fibers together and securing the fibers together at one location at least to form the mop and that somewhere during the production of the mop the fibers are treated to a sufficient amount of a surfactant to produce up to 4.0 percent by weight of the surfactant per weight of the fiber while retaining substantially all the natural oils of the fiber.

The mop of the present invention is composed of these natural fibers containing substantially all of the natural oils inherent in the natural fibers and being provided with a coating of up to 4.0 percent by weight of a surfactant that may be selected from an ionic, nonionic, or cationic surfactant per weight of the fiber. A more preferable amount of the surfactant utilized is 0.4 to 0.8 percent of the surfactant per weight of the fiber.

BRIEF DESCRIPTION OF THE DRAWINGS

The FIGURE is a perspective view of the mop produced in accordance with the process of the invention.

DESCRIPTION OF A SPECIFIC EMBODIMENT

In the production of the mop of the present invention either cotton or wool or other natural fibers inherently possessing natural oils can be utilized. For the purposes of this invention, however, reference will be made to the mops being composed of natural cotton fibers retaining substantially all of the natural oils or other oleagineous materials inherently present in such cotton fibers.

These cotton fibers are generally elongated and may be formed into strands and twisted into yarns or the like in any conventional manner well known to the art. The fibers either individually, or preferably as yarns, are gathered usually at one end with a conventional tie that may be a wire surrounding the ends of these fibers or the securing means could be other cotton fibers or plastic material all of which is well known in the art for forming mops. The method of assembling the fibers to form the mop is not in any way a critical aspect of the present invention and could be accomplished in any manner well known in the art.

The present invention, however, is the discovery that these cotton fibers possess a natural oil that has heretofore been able to inhibit, if not prevent, the use of such mops in an aqueous medium because the oils would limit, if not prevent, the pick up or retention of the aqueous medium thereby limiting the effectiveness of the mop in cleaning or treating of a surface.

This effect of the inherent present of the natural oil can be overcome in accordance with the present invention by reason of the application of a coating of a surfactant to the fibers at any time before or after the formation of the fibers into the form of a mop. Thus the treatment with the surfactant may be to the individual fibers prior to formation into yarn or the surfactant may be supplied to the yarn or it is possible for the mop to be constructed in final form and then the surfactant be applied to the fibers or yarns that have been previously formed into the mop. The present invention is not particularly concerned with the chronology of the application of the surfactant to the fibers but rather that it is supplied and supplied in a specified quantity.

The surfactants that have been found useful in accordance with the present invention include any of the well known surfactants whether they be anionic, nonionic or cationic. For illustrative purposes only it has been found that nonionic surfactants may be formed from the condensation products of ethylene oxide with fatty alcohols, fatty acids, fatty amines, fatty amides, alkylphenols and aliphatic mercaptans. As examples of anionic surfactants it is possible to utilize those surfactants that include the sulfonation of fatty acids, fatty alcohols, fatty esters, fatty aldehydes, fatty ketones, fatty acid nitriles, benzene, naphthalene, anthracene, phthalic anhydride, rosin, terpene and phenol.

Particular examples of the useful surfactants are those that are naturally in the liquid form such as the alkyl phenoxy polyethyleneoxy ethanols particularly in which the alkyl group contains 8 to 9 carbon atoms. Also effective are polyoxyethylene sorbitan monolaurate, polyoxyethylene monolaurate, polyoxyethylene sorbitan monopalmitate and polyoxyethylene sorbitan monostearate which products are known respectively as Tween 20, 21, 40 and 60.

The preferable method of application of the surfactant to the fibers is by spraying. In such a manner the natural oils of the fibers are not removed. However it is possible to immerse the fibers either at the time prior to manufacture of the mop or in the form of a completed mop into a tank of a surfactant of choice with retention of substantially all of these natural oils.

The amount of the surfactant to be applied to the fiber is important and should be at the maximum up to 4.0 percent surfactant by weight of the fiber. Preferably the amount of the surfactant does not exceed 1.0 percent by weight of the fiber and preferably the amount should be at least 0.4 percent surfactant per weight of the fiber up to a most preferred amount of 0.8 percent surfactant per weight of fiber.

As a specific example of the present invention, the fibers at the time of their spinning into yarns are sprayed with Tween 40, polyoxyethylene sorbitan monopalmitate, in order that the amount of surfactant is about 0.5 to 0.6 percent surfactant per weight of the fiber. Essentially none of the natural oils have been lost from the cotton mop and the spraying has taken only a few seconds per mop thus avoiding the long breaking-in period that had previously been presumed necessary. Thereafter the mop when in contact with the aqueous medium is readily absorbent of the aqueous medium and the mop is available for immediate use.

It should be apparent that the foregoing description meets the purposes of the present invention and this invention should be limited in scope solely by the appended claims in which I claim:

1. A process for making a mop for treating surfaces comprising:

providing a plurality of natural fibers possessing natural oils inherent in said fibers, gathering said fibers together, securing said fibers together at one location at least to form a mop, chronologically subsequent to the above step of providing said fibers, the step of, applying to said fibers a sufficient amount of a surfactant while retaining substantially all the natural oils of said fibers in order to produce up to 4.0 percent by weight of surfactant per weight of said fiber on said fibers, whereby said mop possesses improved liquid retention properties without the conventional breaking-in or rinsing of the mop.

2. The process of claim 1 including, said surfactant being present in the amount of at least 0.4 percent by weight per weight of fiber.

3. The process of claim 1 including, said surfactant being present in the amount of 0.4 to 0.8 percent by weight per weight of fiber.

4. The process of claim 1 including, said surfactant being present in the amount of less than 1.0 percent by weight per weight of fiber.

5. The process of claim 1 including, said fibers being in the form of cotton yarns.

6. The process of claim 5 including, said yarns being twisted.

7. The process of claim 1 including, said applying of said surfactant to said fibers being by spraying.

8. The process of claim 1 including, said applying of said surfactant to said fiber being by immersion of said fibers into said surfactant for a sufficiently short time.

9. The process of claim 1 including, said surfactant being anionic, nonionic or cationic and said fibers being cotton.

10. The process of claim 1 including, said surfactant being a nonionic selected from the group consisting of condensation products of ethylene oxide with fatty alcohols, fatty acids, fatty amines, fatty amides, alkylphenols and aliphatic mercaptans.

11. The process of claim 1 including, said surfactant being anionic and selected from the group consisting of sulfonation of fatty acids, fatty alcohols, fatty esters, fatty aldehydes, fatty ketones, fatty acid nitriles, benzene, naphthalene, anthracene, phthalic anhydride, rosin, terpene and phenol.

* * * * *